US011141991B2

(12) United States Patent
Endo et al.

(10) Patent No.: US 11,141,991 B2
(45) Date of Patent: Oct. 12, 2021

(54) INKJET PRINTING DEVICE

(71) Applicant: RISO KAGAKU CORPORATION, Tokyo (JP)

(72) Inventors: Hiroki Endo, Ibaraki (JP); Hiroshi Sugitani, Ibaraki (JP); Ryosuke Miyachi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/668,386

(22) Filed: Oct. 30, 2019

(65) Prior Publication Data

US 2020/0164659 A1 May 28, 2020

(30) Foreign Application Priority Data

Nov. 22, 2018 (JP) ..... JP2018-219354

(51) Int. Cl.
*B41J 2/185* (2006.01)

(52) U.S. Cl.
CPC ..... *B41J 2/185* (2013.01); *B41J 2002/1853* (2013.01)

(58) Field of Classification Search
CPC combination set(s) only.
See application file for complete search history.

(56) References Cited

U.S. PATENT DOCUMENTS 6,336,722 B1 * 1/2002 Wotton ..... B41J 11/002 347/102
8,376,511 B2 2/2013 Shimoda et al.
9,505,218 B2 11/2016 Ujiie et al.
9,604,451 B2 3/2017 Nakamura
9,815,301 B2 11/2017 Maesaka
2010/0079545 A1 4/2010 Shimoda et al.
2011/0069115 A1 3/2011 Tanabe et al.
2011/0227999 A1 9/2011 Tachibana
2014/0240397 A1 8/2014 Masuda
2016/0031219 A1 2/2016 Ujiie et al.
2016/0152024 A1 6/2016 Nakamura
2017/0087881 A1 3/2017 Maesaka

FOREIGN PATENT DOCUMENTS

CN 101712231 5/2010
CN 105313475 2/2016
CN 105644147 6/2016
CN 106965571 7/2017
JP 2007-216420 8/2007
JP 2009-234073 10/2009
JP 2010-058441 3/2010
JP 2011-088103 5/2011
JP 2013-244694 12/2013
JP 2015-139978 8/2015

OTHER PUBLICATIONS

Chinese Office Action issued in Chinese Patent Application No. CN201911139932.3 dated Sep. 30, 2020.

* cited by examiner

*Primary Examiner* — Lam S Nguyen
(74) *Attorney, Agent, or Firm* — Greenblum & Bernstein, P.L.C.

(57) ABSTRACT

An inkjet printing device includes an inkjet head that ejects ink to paper to be transported, a blocking unit that blocks ink mist on a downstream side of the inkjet head in a transport direction of paper, an ink mist collection mechanism and a belt platen that collect ink mist blocked by the blocking unit.

6 Claims, 9 Drawing Sheets

INKJET PRINTING DEVICE

TECHNICAL FIELD

The present invention relates to an inkjet printing device that performs printing by ejecting ink from an inkjet head.

RELATED ART

An inkjet printing device that performs printing by ejecting ink from an inkjet head to paper, while transporting paper has been known.

In such an inkjet printing device, ink mist is generated around the inkjet head due to ejection of ink from the inkjet head. Ink mist is caused to flow to a downstream side in a transport direction of paper by an air current generated by the transport of the paper, to contaminate a member such as a guide plate that guides the paper. Therefore, there is a possibility that a printed material is contaminated due to contact of the printed material with the member contaminated by ink mist.

Meanwhile, Japanese Patent Application Publication No. 2015-139978 discloses a device that collects ink mist in a suction transport mechanism by using a suction wind in the suction transport mechanism that transports paper while sucking and holding the paper by air suction.

However, even if the suction transport mechanism is used, ink mist cannot be sucked in a region where the paper is adsorbed. Accordingly, ink mist cannot be collected sufficiently. As a result, ink mist may flow to a downstream side. Therefore, according to the device disclosed in Japanese Patent Application Publication No. 2015-139978, there is a possibility that a member such as a guide plate is contaminated by ink mist that is not collected and flows to the downstream side, thereby contaminating the printed material.

The present invention has been achieved in view of the problem described above, and an object of the present invention is to provide an inkjet printing device that can reduce contamination of a printed material.

SUMMARY

In order to achieve the above object, an inkjet printing device according to the present invention comprises: an inkjet head that ejects ink to paper to be transported; a blocking unit that blocks ink mist on a downstream side of the inkjet head in a transport direction of paper; and a collection unit that collects ink mist blocked by the blocking unit.

According to the inkjet printing device of the present invention, it is possible to reduce contamination of a printed material.

BRIEF DESCRIPTION OF DRAWINGS

The invention will now be described with reference to the accompanying drawings wherein.

DETAILED DESCRIPTION

Embodiments of the present invention will be described below with reference to the drawings. In the descriptions of the drawings explained below, like or similar reference signs are denoted to like or similar parts and constituent elements.

The following embodiments are only examples illustrating a device or the like for realizing the technical ideas of the present invention, and in the technical ideas of the invention, materials, forms, structures, arrangements, and the like of respective component parts are not limited to those in the embodiments described below. The technical ideas of the present invention can be variously modified within the scope of claims.

First Embodiment

Figure 1:
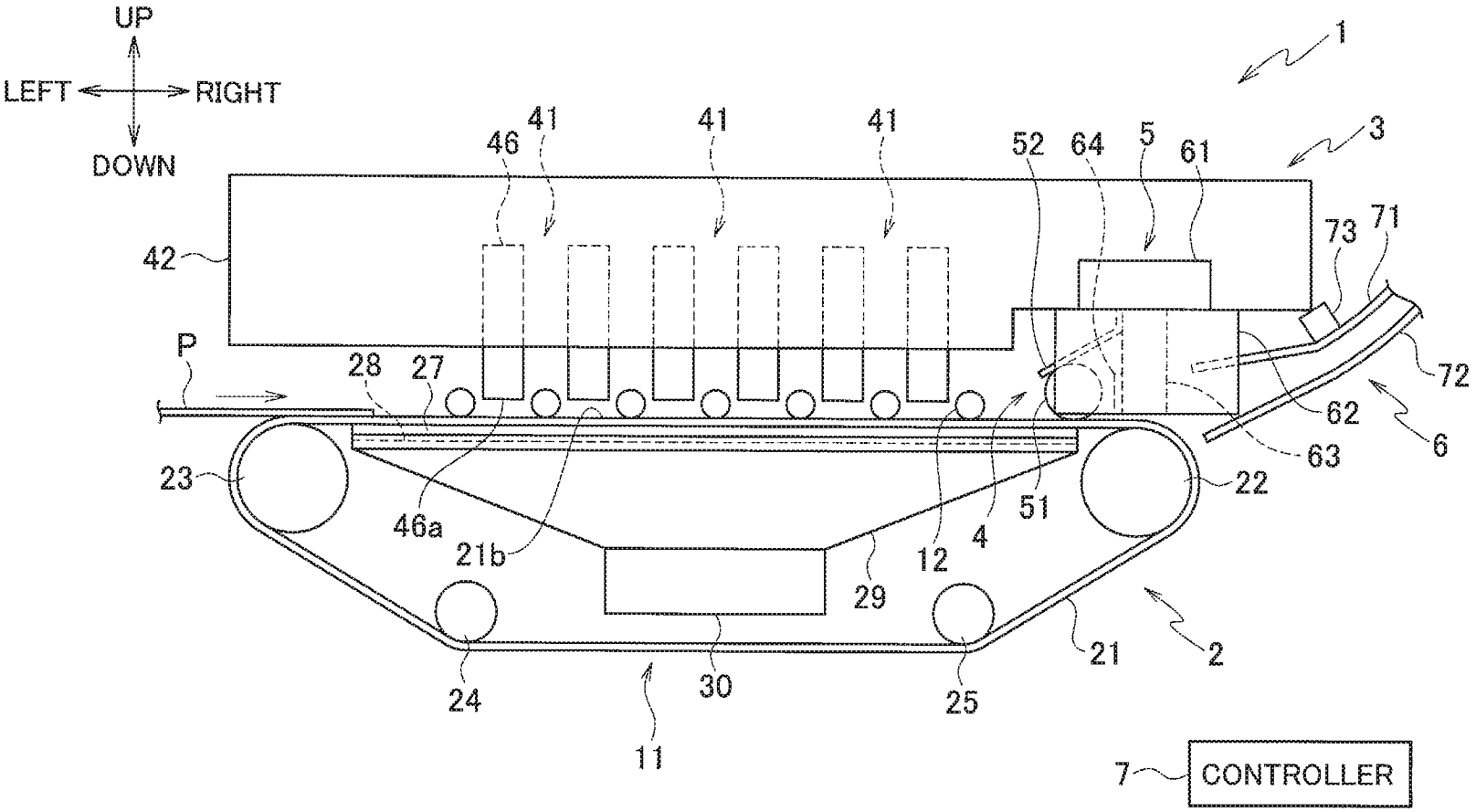
FIG. 1 is a schematic configuration diagram of an inkjet printing device according to a first embodiment.
Figure 2:
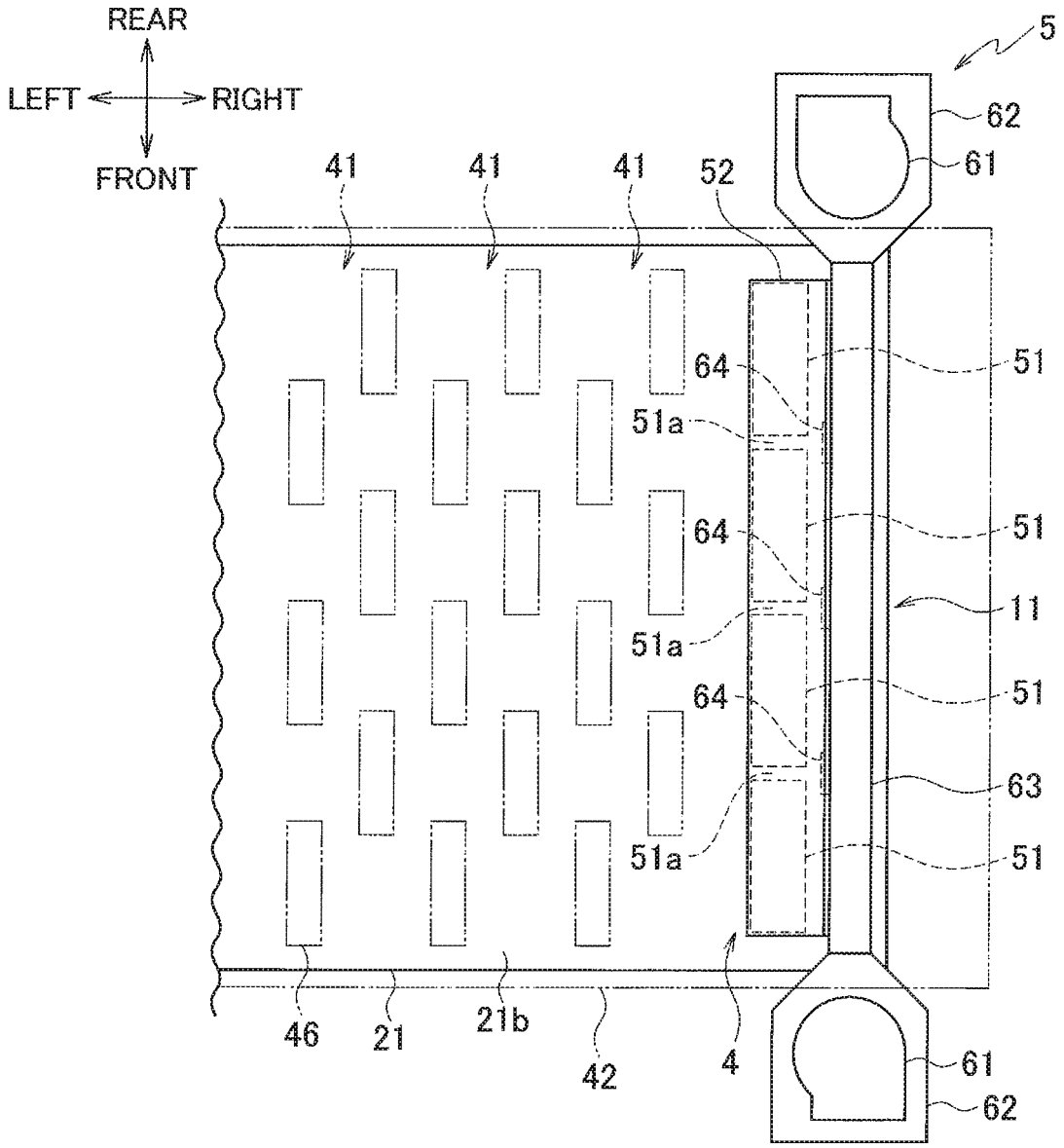
FIG. 2 is a plan view of a vicinity of a blocking unit and an ink mist collection mechanism in the inkjet printing device illustrated in FIG. 1.
Figure 3:
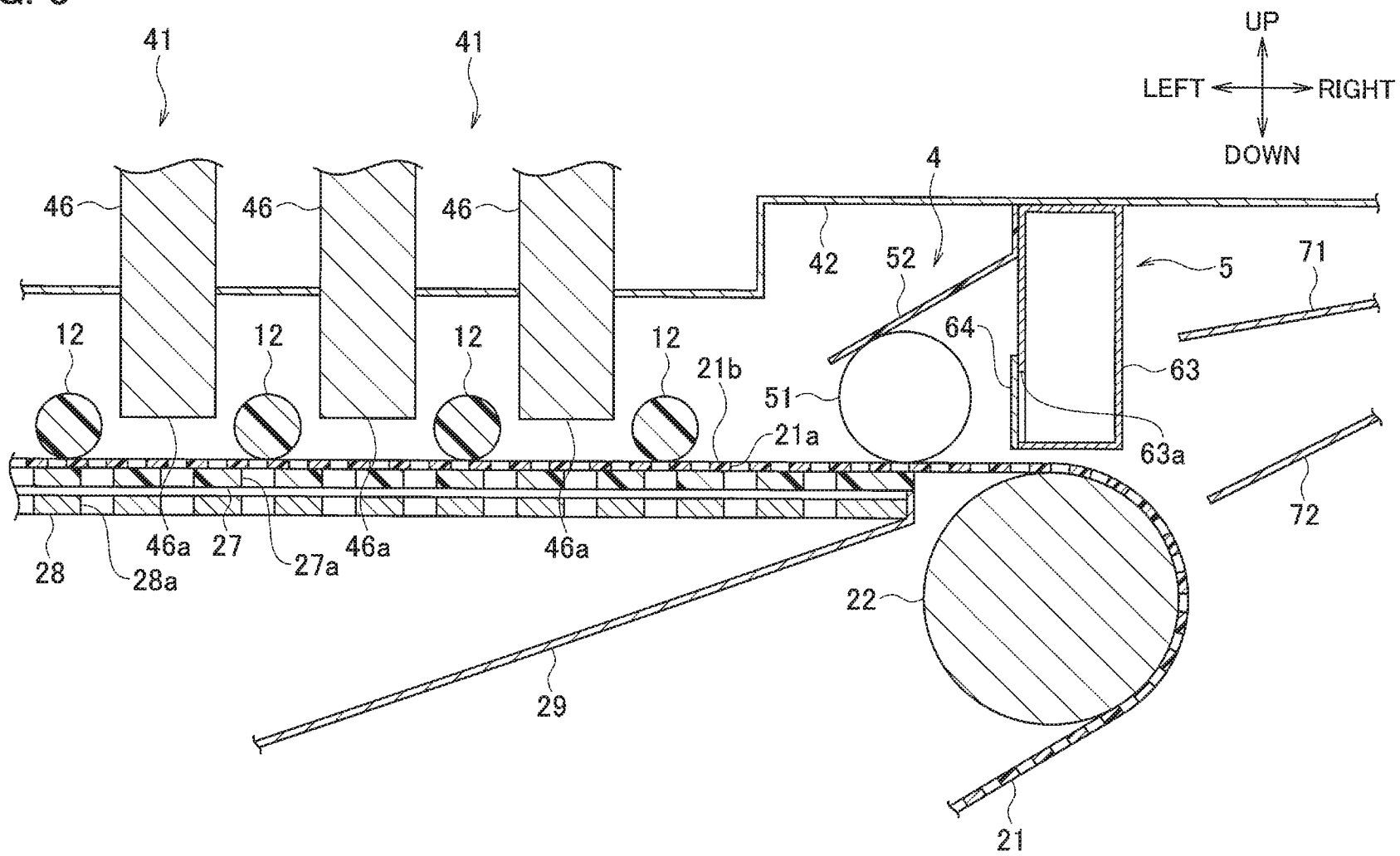
FIG. 3 is a partial enlarged sectional view of a vicinity of the blocking unit and the ink mist collection mechanism in the inkjet printing device illustrated in FIG. 1.
Figure 4:
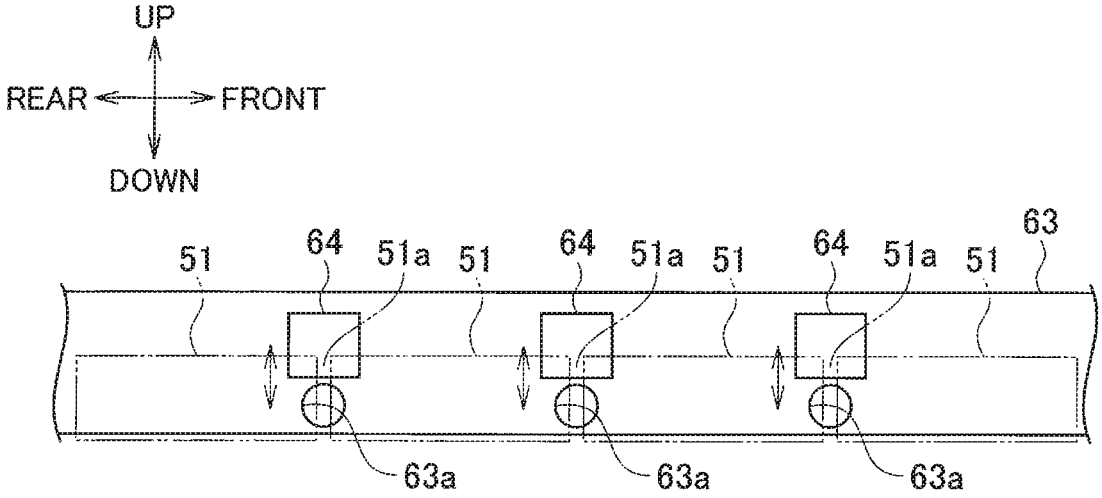
FIG. 4 is an enlarged view of relevant parts of the ink mist collection mechanism in the inkjet printing device illustrated in FIG. 1.
Figure 5:
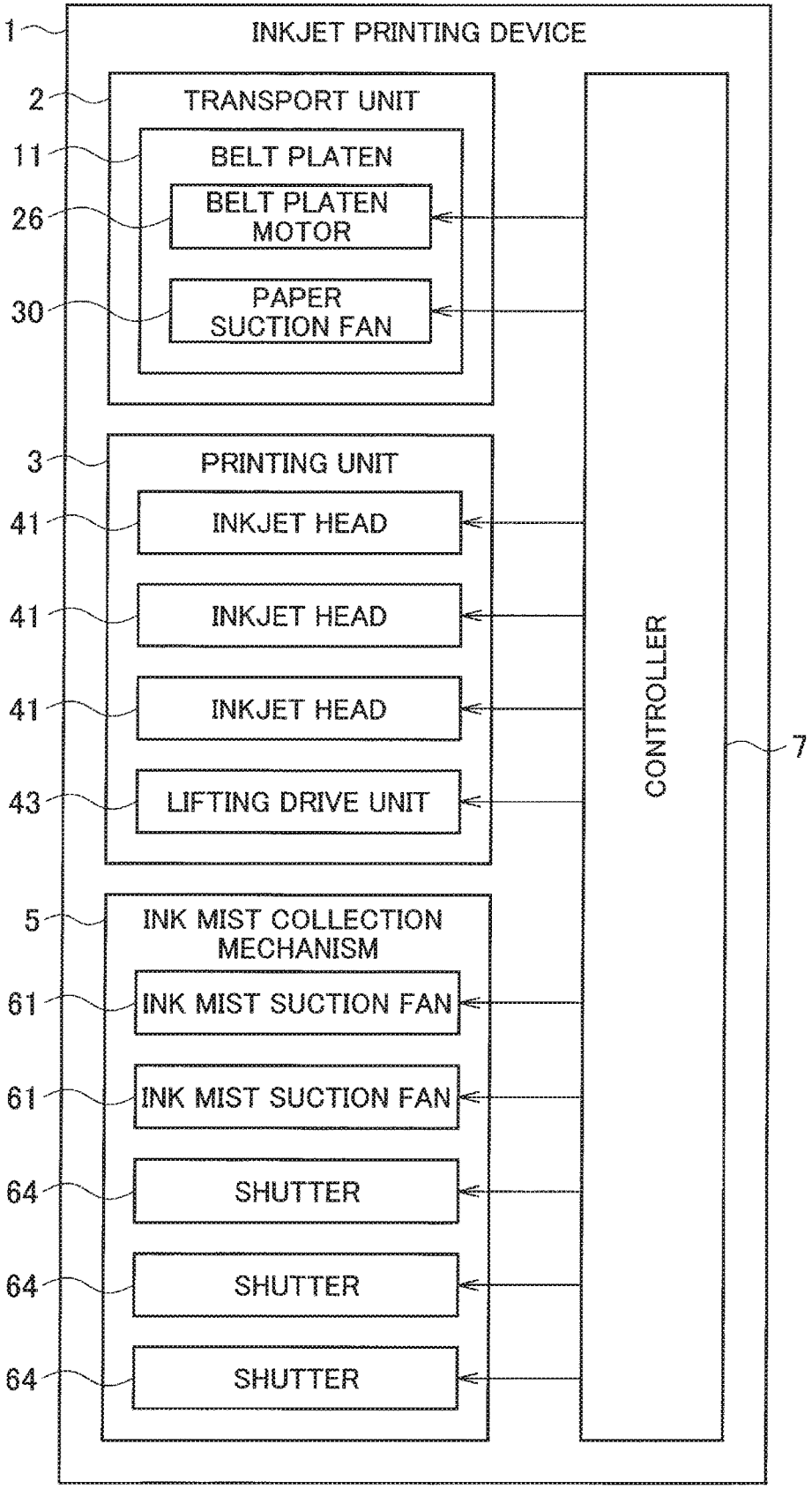
FIG. 5 is a control block diagram of the inkjet printing device illustrated in FIG. 1.

FIG. 1 is a schematic configuration diagram of an inkjet printing device according to a first embodiment of the present invention. FIG. 2 is a plan view of a vicinity of a blocking unit and an ink mist collection mechanism in the inkjet printing device illustrated in FIG. 1. FIG. 3 is a partial enlarged sectional view of a vicinity of the blocking unit and the ink mist collection mechanism. FIG. 4 is an enlarged view of relevant parts of the ink mist collection mechanism. FIG. 5 is a control block diagram of the inkjet printing device illustrated in FIG. 1.

In the following descriptions, a direction orthogonal to the drawing in FIG. 1 is a front-rear direction, and a surface direction of the drawing is a front side. Further, up and down and right and left of the drawing in FIG. 1 are vertical and horizontal directions, respectively. In FIG. 1, a direction from the left to the right is a transport direction of paper P, which is a printing medium. In the following descriptions, upstream and downstream mean upstream and downstream in the transport direction of the paper P.

As illustrated in FIG. 1 and FIG. 5, an inkjet printing device 1 according to the first embodiment includes a transport unit 2, a printing unit 3, a blocking unit 4, an ink mist collection mechanism (corresponding to a downstream collection unit of a collection unit) 5, a guide unit 6, and a controller 7.

The transport unit 2 transports the paper P fed from a paper feeder (not illustrated). The transport unit 2 includes a belt platen (corresponding to an upstream collection unit of the collection unit) 11 and a plurality of paper pressing rollers 12.

The belt platen 11 transports the paper P while sucking and holding the paper P by air suction. The belt platen 11 also has a function of sucking and collecting ink mist. The belt platen 11 includes a transport belt 21, a drive roller 22, driven rollers 23 to 25, a belt platen motor 26, a platen 27, a platen plate 28, a chamber 29, and a paper suction fan 30.

The transport belt 21 transports the paper P by sucking and holding the paper P. The transport belt 21 is an annular belt spanned over the drive roller 22 and the driven rollers 23 to 25. A large number of belt holes 21*a* being through-holes are formed in the transport belt 21. The transport belt 21 sucks and holds the paper P on a transport surface 21*b* by a suction force generated in the belt holes 21*a* due to drive of the paper suction fan 30. The transport surface 21*b* is an upper surface of a horizontal portion of the transport belt 21 between the drive roller 22 and the driven roller 23. The transport belt 21 transports the paper P placed on the transport surface 21*b* rightward by being rotated in a clockwise direction in FIG. 1.

The drive roller 22 rotates the transport belt 21 in the clockwise direction in FIG. 1.

The driven rollers 23 to 25 support the transport belt 21 together with the drive roller 22. The driven rollers 23 to 25 are rotated by following the rotation of the drive roller 22 via the transport belt 21. The driven roller 23 is arranged leftward of the drive roller 22 at the same height as the drive roller 22. The driven rollers 24 and 25 are arranged below the drive roller 22 and the driven roller 23 and away from each other in the horizontal direction at the same height.

The belt platen motor 26 rotationally drives the drive roller 22.

The platen 27 is arranged below the transport belt 21 between the drive roller 22 and the driven roller 23 to support the transport belt 21 slidably. The platen 27 is formed with a large number of suction holes 27*a*, which are through-holes. The suction holes 27*a* are formed at positions at which the belt holes 21*a* pass.

The platen plate 28 is arranged below the platen 27 to equalize the amount of suction wind generated by the paper suction fan 30 with respect to the belt holes 21*a* and the suction holes 27*a* in the platen 27. The platen plate 28 is foamed with a large number of suction holes 28*a* over the whole surface thereof.

The chamber 29 forms a negative pressure chamber so as to generate a suction force in the belt holes 21*a* of the transport belt 21. The chamber 29 is provided on a rear surface side of the platen 27 between the drive roller 22 and the driven roller 23.

The paper suction fan 30 evacuates the chamber 29. Accordingly, the paper suction fan 30 generates a negative pressure in the chamber 29 to suck air via the suction holes 28*a* in the platen plate 28, the suction holes 27*a* in the platen 27, and the belt holes 21*a*. Accordingly, the suction force is generated in the belt holes 21*a* and the paper P is sucked to the transport surface 21*b* of the transport belt 21. Further, ink mist is sucked from the belt holes 21*a*, which are not blocked by the paper P at a position between pieces of paper, and is collected in the chamber 29.

The paper pressing roller 12 is a member that presses the paper P transported by the transport belt 21. The paper pressing roller 12 is rotated by following the rotation of the transport belt 21.

The printing unit 3 performs printing on the paper P transported by the transport unit 2. The printing unit 3 includes three inkjet heads 41, a head holder 42, and a lifting drive unit 43.

The inkjet head 41 ejects ink to the paper P to print an image thereon. Three inkjet heads 41 are arranged in parallel along a sub-scanning direction (horizontal direction), which is a transport direction of the paper P. As illustrated in FIG. 2, the respective inkjet heads 41 respectively have six head modules 46.

The head module 46 has a plurality of nozzles (not illustrated) that are open in an ejection surface 46*a*, which is a lower surface facing the transport surface 21*b* of the transport belt 21, to eject ink from the nozzles. The nozzles are arranged along a main scanning direction (a front-rear direction).

In the inkjet head 41, the head modules 46 are arranged in a staggered manner along the main scanning direction. That is, in the respective inkjet heads 41, six head modules 46 arranged along the main scanning direction are arranged at alternately shifted positions in the sub-scanning direction.

The head holder 42 holds the inkjet heads 41. The head holder 42 is formed by a hollow box. The head holder 42 is arranged above the belt platen 11. A plurality of openings, to which the respective head modules 46 of the respective inkjet heads 41 are attached, are formed on a bottom surface of the head holder 42. The head holder 42 holds the head modules 46 of the respective inkjet heads 41, in such a manner that lower ends of the head modules 46 project downward from the openings.

The lifting drive unit 43 moves the belt plate 11 upward and downward. The lifting drive unit 43 includes a motor or the like (not illustrated).

The blocking unit 4 is to block ink mist flowing to the downstream side, on the downstream side of the inkjet head 41 on the most downstream side. The blocking unit 4 is arranged at a downstream end (a right end) of the transport surface 21*b* of the belt platen 11. The blocking unit 4 includes four blocking rollers 51 and a blocking sheet 52.

The blocking roller 51 is a member for blocking ink mist on the transport surface 21*b*. The blocking roller 51 is arranged at the downstream end (the right end) of the transport surface 21*b* so that a direction of a rotation shaft thereof is parallel to the front-rear direction, and is rotated by following the rotation of the transport belt 21. The four blocking rollers 51 are arranged along the front-rear direction with a predetermined gap (an opening) 51*a* therebetween. That is, in the blocking unit 4, three gaps 51*a* are arranged with an interval therebetween along the front-rear direction. An upstream side and a downstream side of the blocking unit 4 communicate with each other via the gaps 51*a*.

The blocking sheet 52 is a member that blocks ink mist shifting beyond the blocking rollers 51. The blocking sheet 52 is made of a sheet-like member long in the front-rear direction. The blocking sheet 52 is arranged above the blocking rollers 51 so as to cover the four blocking rollers 51. The blocking sheet 52 is attached to a duct 63 of the ink mist collection mechanism 5 described later.

The ink mist collection mechanism 5 is for collecting ink mist temporarily blocked by the blocking unit 4 via the gaps 51*a* of the blocking unit 4. The ink mist collection mechanism 5 is installed near the downstream side of the blocking unit 4 at a position on an upstream side of the guide plates 71 and 72 described later.

The ink mist collection mechanism 5 includes two ink mist suction fans 61, two connecting portions 62, the duct 63, and three shutters 64.

The ink mist suction fan 61 exhausts air from the connecting portions 62 and the duct 63. Accordingly, the ink mist suction fan 61 generates a negative pressure in the connecting portions 62 and the duct 63 and sucks the air including ink mist from a space above the transport surface 21*h* via a suction port 63*a* of the duct 63 described later. The ink mist suction fan 61 is connected one by one to a front end and a rear end of the duct 63 via the connecting portions 62.

The connecting portion 62 connects the ink mist suction fan 61 to the duct 63. The connecting portion 62 is formed by a hollow box. The connecting portion 62 is connected one by one to the front end and the rear end of the duct 63.

The duct 63 forms a flow channel of air for sucking the air including ink mist from the space above the transport surface 21*b* by the ink mist suction fan 61. The duct 63 is formed in a prismatic hollow shape long in the front-rear direction. The duct 63 is attached to a lower surface of the head holder 42. As illustrated in FIG. 4, the duct 63 has three suction ports 63*a* formed in a lower part of an upstream-side (left-side) surface thereof.

The suction port 63*a* is an opening for sucking the air including ink mist into the duct 63. The three suction ports 63*a* are arranged with an interval therebetween along the front-rear direction. The three suction ports 63*a* are provided respectively correspondingly to the three gaps 51*a* of the blocking unit 4. That is, the three suction ports 63*a* are arranged at positions at which the suction ports 63*a* overlaps on the three gaps 51*a* in the front-rear direction, respectively. The suction ports 63*a* are open in the vicinity of an upper part of the transport surface 21*b* at the downstream end of the transport surface 21*b*.

The shutter 64 opens and closes the suction port 63*a* of the duct 63. The shutter 64 is configured to be able to adjust an opening area of the suction port 63*a*. Three shutters 64 are provided respectively correspondingly to the three suction ports 63*a*. The shutter 64 is driven by a motor (not illustrated).

The guide unit 6 guides the paper P transported to the downstream side of the transport unit 2. The guide unit 6 includes a pair of guide plates 71 and 72, and a shielding member 73.

The guide plates 71 and 72 are members that guide the paper P transported from the belt platen 11 to a transport mechanism (not illustrated) on a downstream side thereof.

The shielding member 73 is a member that shields between the head holder 42 and the guide plate 71 in order to suppress diffusion of ink mist.

The controller 7 controls operations of the respective units of the inkjet printing device 1. The controller 7 is configured to include a CPU, a RAM, a ROM, a hard disk, and the like.

Next, operations of the inkjet printing device 1 are explained.

Upon input of a printing job, the controller 7 controls the lifting drive unit 43 so as to adjust a height position of the belt platen 11 according to the type of paper to be used in printing by the printing job. Accordingly, a head gap, which is a distance between the ejection surface 46*a* and the paper P on the transport surface 21*b* at the time of transporting the paper P by the belt platen 11, becomes a size corresponding to the paper type.

Subsequently, the controller 7 starts to drive the belt platen 11. Specifically, the controller 7 starts to drive the drive roller 22 by the belt platen motor 26. Accordingly, the transport belt 21 is started to drive in a move-around manner. Further, the controller 7 starts to drive the paper suction fan 30. When downward exhaust is performed from the chamber 29 due to the drive of the paper suction fan 30, the air is sucked into the chamber 29 via the suction holes 28*a* of the platen plate 28, the suction holes 27*a* of the platen 27, and the belt holes 21*a* of the transport belt 21. Accordingly, a negative pressure is generated in the belt holes 21*a* to generate a suction force.

The controller 7 starts to drive the ink mist collection mechanism 5. Specifically, the controller 7 starts to drive the two ink mist suction fans 61 and opens the suction ports 63*a* of the duct 63 by controlling the shutters 64.

The controller 7 determines the suction port 63*a* to be opened according to the size of the paper P to be printed. Specifically, when the paper P having a size with a paper width (a length in the front-rear direction of the paper P) being less than a threshold is to be printed, the controller 7 opens the central suction port 63*a*, and closes the frontmost suction port 63*a* and the rearmost suction port 63*a*. When the paper P having a size with the paper width being equal to or larger than the threshold is to be printed, the controller 7 opens all the suction ports 63*a*. Here, in the inkjet printing device 1, the paper P is transported in such a manner that the center of the transport surface 21*b* and the center of the paper P in the front-rear direction are matched with each other on the belt platen 11.

Further, the controller 7 controls the shutter 64 corresponding to the suction port 63*a* to be opened so that an opening area of the suction port 63*a* becomes a size corresponding to a coverage rate with respect to a first piece of paper P and the head gap.

When the head gap is the same, as the coverage rate becomes lower, the opening area of the suction port 63*a* is set to be smaller. Further, when the coverage rate is the same, as the head gap becomes smaller, the opening area of the suction port 63*a* is set to be smaller. As the coverage rate becomes lower and as the head gap becomes smaller, ink mist to be generated decreases. Therefore, it is possible to suppress degradation in the printing image quality due to the influence of suction wind by reducing the amount of the suction wind generated by the ink mist collection mechanism 5.

When the drive of the belt platen 11 and the ink mist collection mechanism 5 is started, pieces of paper P for the number of the paper P to be printed in the printing job are fed to the belt platen 11 sequentially. The fed paper P is sucked and held by the transport belt 21 of the belt platen 11 and transported while being pressed by the paper pressing rollers 12 and the blocking rollers 51. In the belt platen 11, respective pieces of paper P are transported with a predetermined interval. The controller 7 causes the inkjet head 41 to eject ink to the paper P transported below the inkjet head 41 to print an image.

The printed paper P is transported by a transport mechanism (not illustrated) on the downstream side of the belt platen 11, while being guided by the guide plates 71 and 72, and is ejected.

Here, after start of the printing operation, the controller 7 controls opening and closing of the suction ports 63*a* according to the position in the transport direction of the transported paper P on the belt platen 11.

Figure 6:
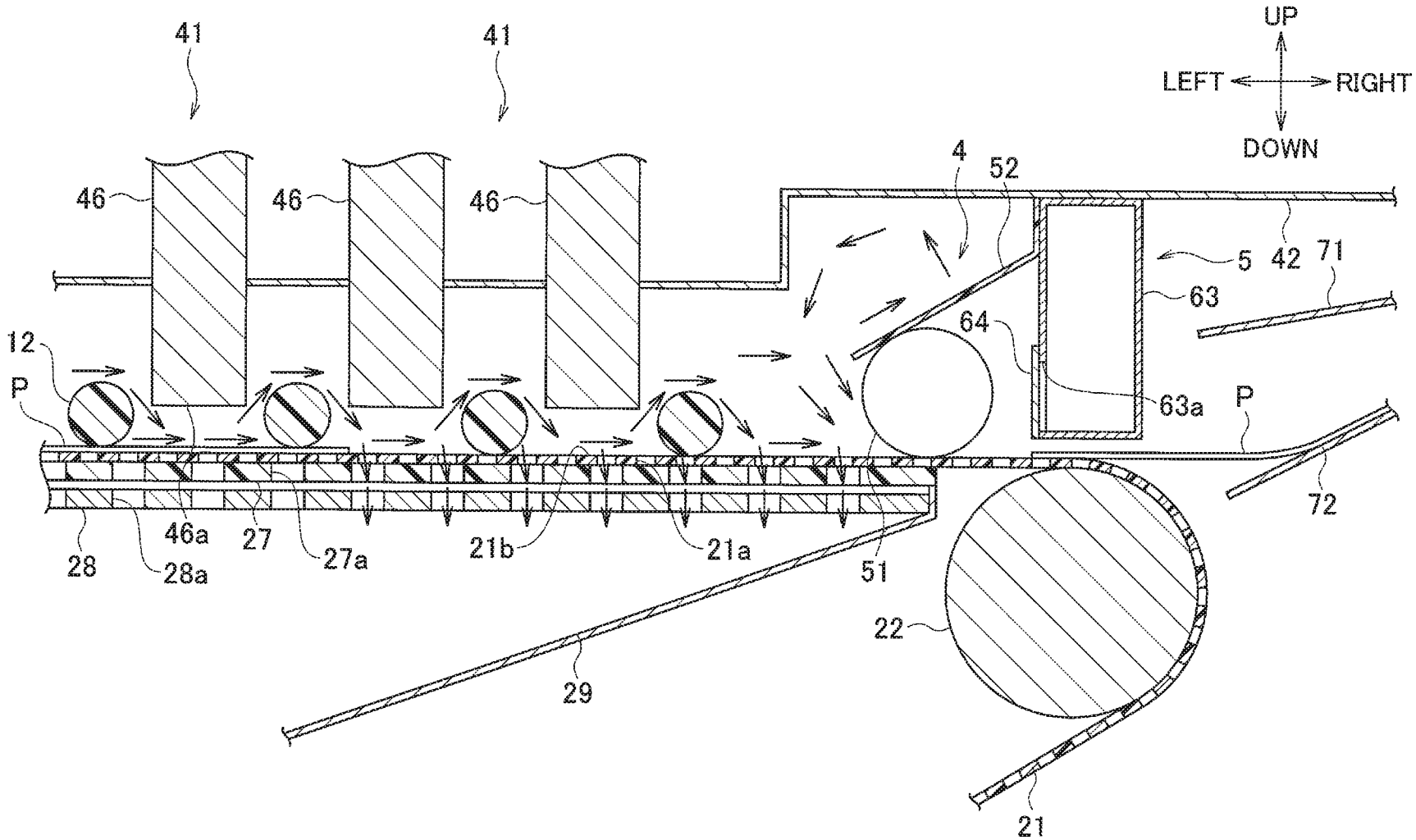
FIG. 6 is diagram illustrating a flow of ink mist to be collected.

Specifically, when a front edge of the paper P has reached the inkjet head 41 on the most downstream side, as illustrated in FIG. 6, the controller 7 closes the suction port 63*a* to be opened by controlling the shutter 64 corresponding to the suction port 63*a*.

Figure 7:
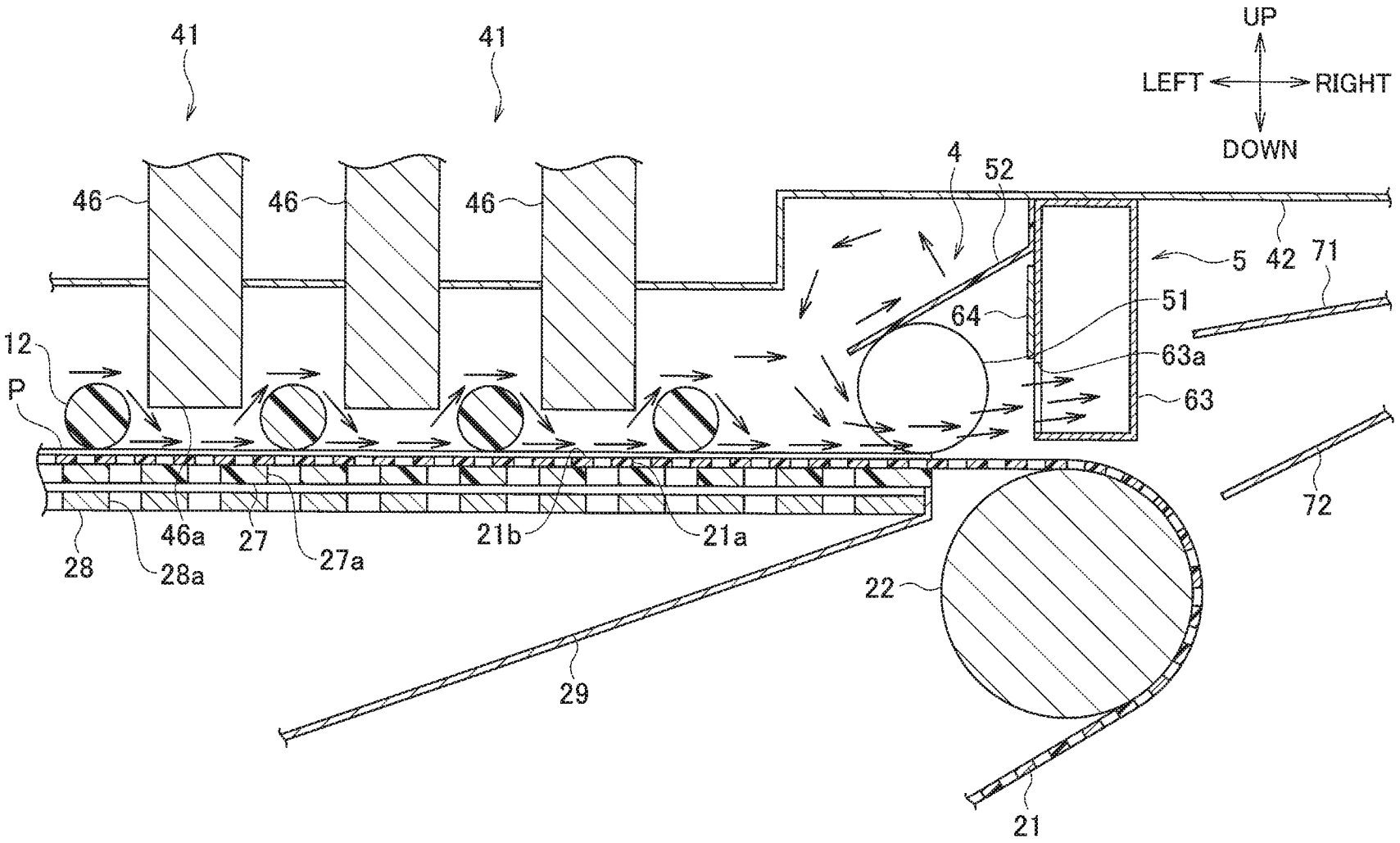
FIG. 7 is diagram illustrating a flow of ink mist to be collected.

Further, when the front edge of the paper P has reached a downstream end of the chamber 29, as illustrated in FIG. 7, the controller 7 opens the suction port 63*a* to be opened by controlling the shutter 64 corresponding to the suction port 63*a*. The downstream end of the chamber 29 corresponds to a downstream end of a region in which ink mist can be sucked from the belt holes 21*a* on the transport surface 21*b*.

The controller 7 determines a timing when the front edge of the paper P reaches the inkjet head 41 on the most downstream side and a timing When the front edge of the paper P reaches the downstream end of the chamber 29, based on a timing when the front edge of the paper P has been detected by a paper sensor (not illustrated) arranged at a predetermined position.

The controller 7 executes opening/closing control of the suction ports 63*a* described above with respect to the respective pieces of paper P sequentially fed to and transported by the belt platen 11.

When the front edge of the paper P has reached the downstream end of the chamber 29 and the controller 7 opens the suction port 63*a* to be opened, the controller 7 controls the shutter 64 so that the opening area of the suction port 63*a* becomes a size corresponding to the coverage rate with respect to the paper P and the head gap.

The amount of suction wind can be adjusted by adjusting the opening area of the suction port 63*a* by the shutter 64, with higher responsiveness than that at the time of controlling the amount of wind of the ink mist suction fan 61. With this adjustment, it is possible to handle high speed printing.

Collection of ink mist by the ink mist collection mechanism 5 in which opening/closing control of the suction port 63*a* is executed as described above and by the belt platen 11 is described.

Ink mist generated by ejection of ink by the inkjet head 41 flows to the downstream side due to a transport air current generated by transport of the paper P by the belt platen 11.

A part of ink mist flowing to the downstream side is collected by the belt platen 11 by being sucked from the belt holes 21*a* that are not blocked by the paper P at a position between pieces of paper or the like, before reaching the blocking unit 4. The ink mist having reached the blocking unit 4 without being collected by the belt platen 11 is blocked by the blocking unit 4. A part of the ink mist blocked by the blocking unit 4 is sucked from the belt holes 21*a* and collected by the belt platen 11, in a state where the belt holes 21*a* in a region near the upstream side of the blocking unit 4 are not blocked by the paper P.

In a state where at least one of the suction ports 63*a* is opened, the other part of the ink mist blocked by the blocking unit 4 passes through the gap 51*a* corresponding to the opened suction port 63*a* and flows to the downstream side of the blocking unit 4 by the suction wind flowing into the opened suction port 63*a*. The ink mist that has flowed to the downstream side of the blocking unit 4 is sucked by the duct 63 via the opened suction port 63*a* and collected by the ink mist collection mechanism 5.

As described above, when the front edge of the paper P reaches the inkjet head 41 on the most downstream side, the suction port 63*a* is closed. Accordingly, as illustrated in FIG. 6, ink mist blocked by the blocking unit 4 is collected only by the belt platen 11. In FIG. 6, the flow of ink mist is indicated by arrows.

In a state where the belt holes 21*a* in the region near the upstream side of the blocking unit 4 are not blocked by the paper P, when the suction port 63*a* of the ink mist collection mechanism 5 is opened, the influence of suction wind by the ink mist collection mechanism 5 is added to turbulence of the air current due to the suction wind to the belt holes 21*a* near the inkjet head 41 on the most downstream side, and thus the turbulence of the air current may increase. Accordingly, there is a possibility that ink droplets ejected from the inkjet head 41 on the most downstream side scatter to cause degradation in the printing image quality. Therefore, the suction port 63*a* is closed when the front edge of the paper P reaches the inkjet head 41 on the most downstream side and ejection of ink is started from the inkjet head 41.

In a state where the front edge of the paper P reaches the downstream end of the chamber 29 and the belt holes 21*a* in the region near the upstream side of the blocking unit 4 are blocked by the paper P, as described above, the suction port 63*a* to be opened is opened. Accordingly, as illustrated in FIG. 7, collection of ink mist by the ink mist collection mechanism 5 is restarted. Accordingly, even in a state where the belt holes 21*a* are blocked by the paper P in a downstream region of the belt platen 11 and suction of ink mist from the belt holes 21*a* is not performed, ink mist flowing to the downstream side can be collected by the ink mist collection mechanism 5. In the example illustrated in FIG. 7, the opening area of the suction port 63*a* is maximum (fully opened).

Figure 8:
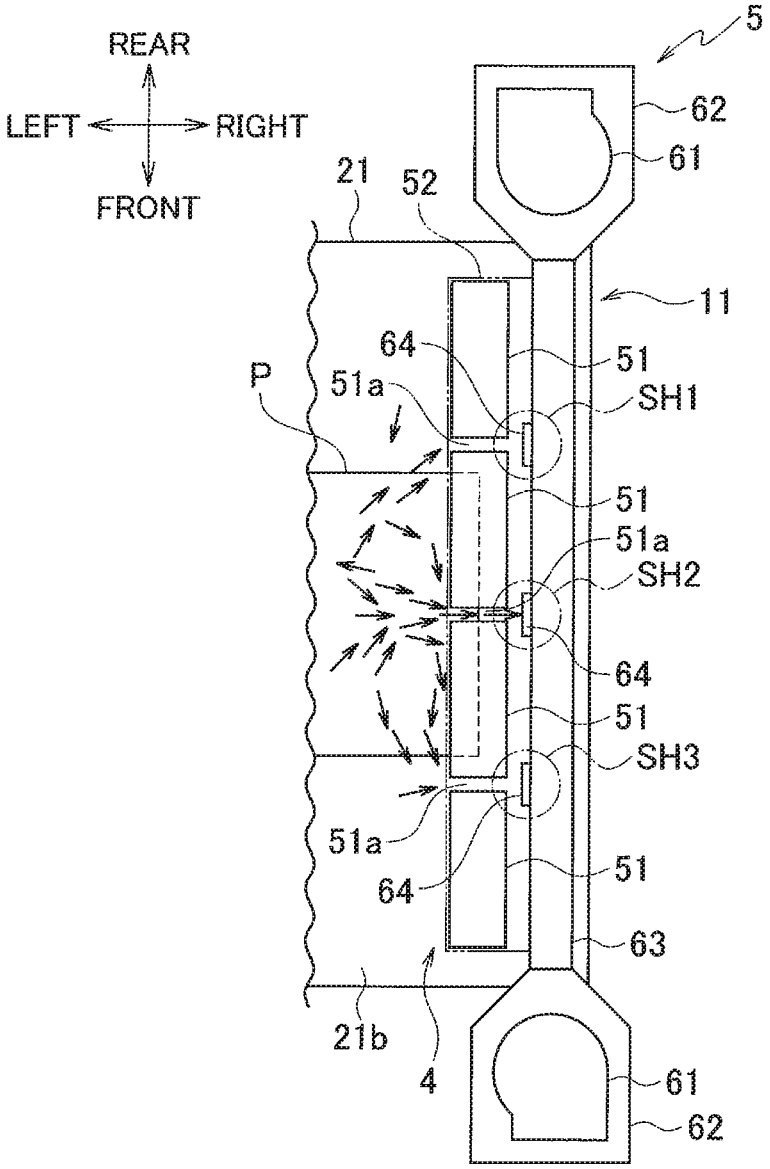
FIG. 8 is diagram illustrating a flow of ink mist to be collected.

The collection state of ink mist by the ink mist collection mechanism 5 as viewed from above is illustrated in FIG. 8. In FIG. 8, the flow of ink mist is indicated by arrows. In the example illustrated in FIG. 8, the central suction port 63*a* (the suction port 63*a* at a position SH2) is opened and the other two suction ports 63*a* (the suction ports 63*a* at positions SH1 and SH3) are closed according to the size (paper width) of the paper P.

Here, since the blocking roller 51 is rotated by following the rotation of the transport belt 21 during the printing operation, ink mist hardly attaches to the blocking roller 51. Therefore, contamination of the paper P by the blocking roller 51 can be suppressed.

In the period after the front edge of the paper P has reached the downstream end of the chamber 29 until the front edge of the next paper P reaches the inkjet head 41 on the most downstream side, the suction port 63*a* to be opened is in an opened state. During this period, collection of ink mist by the ink mist collection mechanism 5 and collection of ink mist by the belt platen 11 from the belt holes 21*a* that are not blocked by the paper P are both performed.

As described above, in the inkjet printing device 1, ink mist flowing to the downstream side of the inkjet head 41 is blocked by the blocking unit 4, and the blocked ink mist is collected by the ink mist collection mechanism 5 and the belt platen 11. Accordingly, collection of ink mist is performed while suppressing that ink mist flows to the downstream side of the transport unit 2. Therefore, ink mist adhering to the guide plates 71 and 72 arranged on the downstream side of the transport unit 2 is reduced. As a result, contamination of the printed material is reduced.

Here, the blocking unit 4 includes gaps 51*a*, and the ink mist collection mechanism 5 sucks and collects ink mist blocked by the blocking unit 4 via the gaps 51*a*. Accordingly, ink mist blocked by the blocking unit 4 can be easily collected. Further, ink mist can be collected more efficiently by collecting the ink mist blocked by the blocking unit 4 by the belt platen 11 on the upstream side of the blocking unit 4.

Further, in the inkjet printing device 1, the shutter 64 adjusts the opening area of the suction ports 63*a* according to the coverage rate and the head gap. Accordingly, it can be suppressed that the amount of suction wind by the ink mist collection mechanism 5 increases more than necessary, thereby enabling to decrease degradation in the printing image quality.

Further, in the inkjet printing device 1, the shutter 64 opens and closes the suction port 63*a* according to the position in the transport direction of the paper P transported on the belt platen 11. Accordingly, it can be suppressed that the influence of suction wind by the ink mist collection mechanism 5 is added to turbulence of the air current due to the suction wind to the belt holes 21*a* to increase the turbulence of the air current, thereby enabling to decrease degradation in the printing image quality.

Further, in the inkjet printing device 1, the respective shutters 64 open and close the suction port 63*a* corresponding to each of the shutters 64 according to the size of the paper P. Accordingly, ink mist can be collected efficiently without generating any unnecessary suction wind.

Second Embodiment

Figure 9:
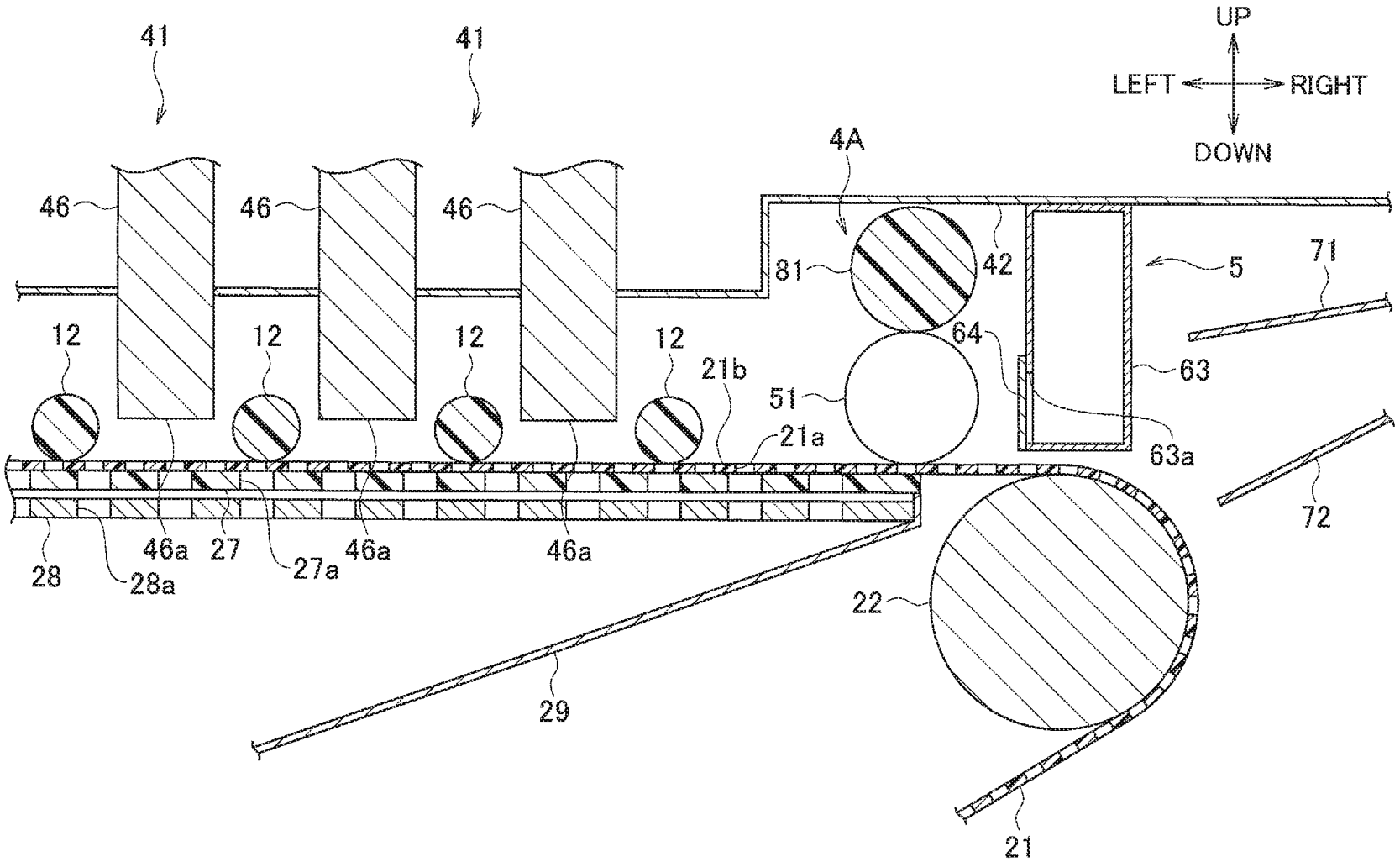
FIG. 9 is a partial enlarged sectional view of a vicinity of a blocking unit and an ink mist collection mechanism according to a second embodiment.

A second embodiment in which the blocking unit in the first embodiment described above is modified is described next. FIG. 9 is a partial enlarged sectional view of a vicinity of a blocking unit and an ink mist collection mechanism according to the second embodiment.

As illustrated in FIG. 9, a blocking unit 4A according to the second embodiment has a configuration in which the blocking sheet 52 of the blocking unit 4 according to the first embodiment described above is replaced by an upper blocking roller 81.

The upper blocking roller 81 is a roller that blocks ink mist shifting beyond the blocking rollers 51. The upper blocking roller 81 is arranged above the blocking rollers 51 and is in contact with the blocking rollers 51. The upper blocking roller 81 is a roller that extends from a front end of the frontmost blocking roller 51 to a rear end of the rearmost blocking roller 51. The upper blocking roller 81 is rotated by following the rotation of the blocking rollers 51.

The blocking unit 4A according to the second embodiment blocks ink mist flowing to the downstream side of the inkjet head 41 during the printing operation, in the same manner as the blocking unit 4 according to the first embodiment. Ink mist blocked by the blocking unit 4A is collected by the ink mist collection mechanism 5 and the belt platen 11.

Accordingly, as in the first embodiment, since collection of ink mist is performed while suppressing that ink mist flows to the downstream side of the transport unit 2, ink mist adhering to the guide plates 71 and 72 arranged on the downstream side of the transport unit 2 decreases. As a result, contamination of the printed material can be reduced.

Further, in the second embodiment, since the upper blocking roller 81 is also rotated together with the blocking rollers 51, ink mist hardly adheres to the blocking unit 4A. Therefore, contamination of the paper P due to transfer of ink from the blocking unit 4A to the paper P can be suppressed.

Other Embodiments

Although the present invention has been described above by reference to the first and second embodiments, it should not be construed that the present invention is limited to the descriptions and the drawings that constitute a part of the present disclosure. On the basis of the present disclosure, various alternative embodiments, practical examples, and operating techniques will be apparent to those skilled in the art.

In the first and second embodiments described above, ink mist blocked by the blocking unit 4, 4A is collected by the ink mist collection mechanism 5 and the belt platen 11. However, a configuration of collecting ink mist blocked by the blocking unit 4, 4A is not limited thereto.

For example, the configuration can be such that the transport unit 2 is of an electrostatic suction type in which the transport unit does not collect ink mist, and ink mist blocked by the blocking unit 4, 4A is collected only by the ink mist collection mechanism 5.

Further, the configuration can be such that, for example, the ink mist collection mechanism 5 is omitted, and ink mist blocked by the blocking unit 4, 4A is collected only by the belt platen 11. In this case, the blocking unit has a configuration of having no opening (no gap).

Further, a configuration of collecting ink mist on an upstream side of the blocking unit can be provided separately from the transport unit.

In the first and second embodiments described above, the coverage rate and the head gap are used for the adjustment of the opening area of the suction port 63*a*. However, any of these can be omitted. Further, the opening area of the suction port 63*a* can be a fixed value.

Further, in the first and second embodiments described above, when the front edge of the paper P reaches the inkjet head 41 on the most downstream side, the suction port 63*a* is closed, and when the front edge of the paper P reaches the downstream end of the chamber 29, the suction port 63*a* is opened. However, the timing to open or close the suction port 63*a* is not limited thereto. For example, the suction port 63*a* can be closed when the front edge of the paper P reaches the inkjet head 41 on an upstream side of the inkjet head 41 on the most downstream side according to a distance between the ink mist collection mechanism 5 and the respective inkjet heads 41.

Further, in the first and second embodiments described above, the blocking unit 4, 4A is provided with three gaps 51*a*. However, the number of openings (gaps) of the blocking unit is not limited thereto. It suffices that the number of openings of the blocking unit is set to the number corresponding to the length in the main scanning direction of the inkjet head.

Further, in the first embodiment described above, the blocking unit 4 is configured by the blocking rollers 51 and the blocking sheet 52. In the second embodiment, the blocking unit 4A is configured by the blocking rollers 51 and the upper blocking roller 81. However, the configuration of the blocking unit is not limited thereto. It suffices that the blocking unit blocks ink mist.

In is needless to mention that the present invention also includes various embodiments that are not described herein. Therefore, the technical scope of the present invention is to be defined only by the invention specifying mailers according to the scope of claims appropriately obtained from the above descriptions.

This application claims priority based on Japanese Patent Application No. 2018-219354 filed on Nov. 22, 2018, and the entire content of this application is incorporated herein by reference.

REFERENCE SIGNS LIST

1 inkjet printing device
2 transport unit
3 printing unit
4 blocking unit
5 ink mist collection mechanism
6 guide unit
7 controller
11 belt platen
41 inkjet head
46 head module
46*a* ejection surface
51 blocking roller
51*a* gap
52 blocking sheet
61 ink mist suction fan

62 connecting portion
63 duct
63*a* suction port
64 shutter
81 upper blocking roller

What is claimed is:

1. An inkjet printing device comprising:

an inkjet head that ejects ink to paper to be transported;

a blocking unit that blocks ink mist from flowing downstream from the blocking unit of the inkjet head in a transport direction of paper; and a downstream collection unit that collects ink mist blocked by the blocking unit, wherein the blocking unit contacts a transport surface of a transport belt transporting the paper and extends from the transport surface to a head holder holding the inkjet head, thereby impeding the flow of the ink mist downstream in the transport direction from the blocking unit.

2. The inkjet printing device according to claim 1, wherein the downstream collection unit includes a suction port that sucks ink mist and a shutter that opens and closes the suction port, and the shutter adjusts an opening area of the suction port according to at least any one of a coverage rate and a gap between an ejection surface of the inkjet head and paper.

3. The inkjet printing device according to claim 2, wherein the blocking unit includes a plurality of openings that connects an upstream side and a downstream side of the blocking unit in the transport direction, the downstream collection unit includes a plurality of the suction ports respectively corresponding to each of the openings and a plurality of the shutters respectively corresponding to each of the suction ports, and the respective shutters open and close the suction port corresponding to the shutter according to a size of paper.

4. The inkjet printing device according to claim 2, further comprising an upstream collection unit that collects ink mist on an upstream side of the blocking unit in the transport direction.

5. The inkjet printing device according to claim 4, wherein the upstream collection unit transports paper while sucking and holding the paper by air suction, and sucks and collects ink mist, and the shutter opens and closes the suction port of the downstream collection unit according to a position in the transport direction of paper to be transported in the upstream collection unit.

6. The inkjet printing device according to claim 5, wherein the blocking unit includes a plurality of openings that connects an upstream side and a downstream side of the blocking unit in the transport direction, the downstream collection unit includes a plurality of the suction ports respectively corresponding to each of the openings and a plurality of the shutters respectively corresponding to each of the suction ports, and the respective shutters open and close the suction port corresponding to the shutter according to a size of paper.

* * * * *